US011512903B2

(12) United States Patent
Sugimura et al.

(10) Patent No.: US 11,512,903 B2
(45) Date of Patent: Nov. 29, 2022

(54) HEAT EXCHANGER

(71) Applicant: DENSO CORPORATION, Aichi-pref. (JP)

(72) Inventors: Ryohei Sugimura, Kariya (JP); Shinichiro Takise, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/218,989

(22) Filed: Mar. 31, 2021

(65) Prior Publication Data

US 2021/0215430 A1 Jul. 15, 2021

Related U.S. Application Data

(63) Continuation of application No. PCT/JP2019/039652, filed on Oct. 8, 2019.

(30) Foreign Application Priority Data

Oct. 30, 2018 (JP) ..... JP2018-203966

(51) Int. Cl.
*F28D 7/16* (2006.01)
*F28F 9/02* (2006.01)

(52) U.S. Cl.
CPC . *F28D 7/16* (2013.01); *F28F 9/02* (2013.01)

(58) Field of Classification Search
CPC .... F28D 7/16; F28D 1/05325; F28D 1/05341; F28D 1/05375; F28D 1/05391; F28F 9/02; F28F 9/0202; F28F 9/0207; F28F 9/0209; F28F 9/0212
USPC ..... 165/175
See application file for complete search history.

(56) References Cited

U.S. PATENT DOCUMENTS 2,004,390 A * 6/1935 Benzinger ..... F28F 9/026 165/110
5,207,738 A * 5/1993 Dey ..... F28F 9/0212 165/173
5,251,694 A * 10/1993 Chigira ..... F28F 9/0224 165/173
5,752,566 A * 5/1998 Liu ..... F28D 1/05375 165/110
5,947,196 A * 9/1999 Halm ..... F28F 9/002 165/173

(Continued)

FOREIGN PATENT DOCUMENTS

CN 101482378 A * 7/2009 ..... F25B 39/04
EP 0887611 A2 12/1998

(Continued)

*Primary Examiner* — Tho V Duong
*Assistant Examiner* — Raheena R Malik
(74) *Attorney, Agent, or Firm* — Harness, Dickey & Pierce, P.L.C.

(57) ABSTRACT

A heat exchanger includes plural tubes, a first tank, and a second tank. Refrigerant flows in order of a first internal passage of the first tank, a first tube, the second tank, a second tube, and a second internal passage of the first tank. A channel forming portion is provided inside the second tank to form a refrigerant channel having a cross-sectional area smaller than that of an internal passage of the second tank in a cross-section orthogonal to a longitudinal direction of the second tank. The refrigerant channel is arranged so that a projection area of the refrigerant channel overlaps the tube when viewed in the longitudinal direction of the second tank.

15 Claims, 15 Drawing Sheets

(56) References Cited

U.S. PATENT DOCUMENTS

| | | | | |
|---|---|---|---|---|
| 6,053,243 | A * | 4/2000 | Kato | F28F 9/0212 165/173 |
| 6,430,945 | B1 * | 8/2002 | Haussmann | B60H 1/3227 62/509 |
| 2011/0220318 | A1 * | 9/2011 | Kopchick | F28F 9/0212 165/41 |
| 2015/0021003 | A1 * | 1/2015 | Cho | F28F 9/028 165/145 |
| 2015/0053383 | A1 * | 2/2015 | Citti | F28D 1/05375 165/173 |
| 2015/0241129 | A1 * | 8/2015 | Cui | F28F 9/028 165/151 |
| 2015/0247678 | A1 * | 9/2015 | Tylutki | F28F 9/0212 165/103 |
| 2017/0153062 | A1 * | 6/2017 | Joardar | F28D 7/0066 |
| 2017/0160016 | A1 * | 6/2017 | Lee | F28F 9/02 |
| 2019/0078812 | A1 | 3/2019 | Ohyama et al. | |

FOREIGN PATENT DOCUMENTS

| | | | |
|---|---|---|---|
| JP | H03247993 | A | 11/1991 |
| JP | 2005140374 | A | 6/2005 |
| JP | 2005241170 | A | 9/2005 |
| JP | 4358981 | B2 | 11/2009 |
| JP | 2013061114 | A | 4/2013 |
| JP | 2015068622 | A | 4/2015 |
| JP | 2017058123 | A | 3/2017 |
| JP | 2017070027 | A | 4/2017 |
| WO | WO-2010078701 | A1 | 7/2010 |

* cited by examiner

HEAT EXCHANGER

CROSS REFERENCE TO RELATED APPLICATIONS

The present application is a continuation application of International Patent Application No. PCT/JP2019/039652 filed on Oct. 8, 2019, which designated the U.S. and claims the benefit of priority from Japanese Patent Application No. 2018-203966 filed on Oct. 30, 2018. The entire disclosures of all of the above applications are incorporated herein by reference.

TECHNICAL FIELD

The present disclosure relates to a heat exchanger.

BACKGROUND ART

A heat exchanger is used as an outdoor heat exchanger of a heat pump cycle of an air conditioner for a vehicle. A refrigerant that circulates in the heat pump cycle flows through the heat exchanger.

SUMMARY

According to one aspect of the present disclosure, a heat exchanger is used as a condenser and an evaporator. A refrigerant containing oil for lubricating a compressor flows through the heat exchanger having plural tubes, a first tank, and a second tank. In the tubes, the refrigerant flows to exchange heat with air flowing outside. The first tank is shaped in a cylinder arranged to extend in a vertical direction and connected to one end of the tubes. The second tank is shaped in a cylinder arranged to extend in the vertical direction and connected to the other end of the tubes. A first internal passage and a second internal passage arranged above the first internal passage in the vertical direction are defined inside the first tank. The plural tubes includes a first tube communicated with the first internal passage of the first tank, and a second tube communicated with the second internal passage of the first tank. The refrigerant flows in order of the first internal passage of the first tank, the first tube, the second tank, the second tube, and the second internal passage of the first tank. A channel forming portion is provided inside the second tank to form a refrigerant channel having a cross-sectional area smaller than that of an internal passage of the second tank in a cross-section orthogonal to a longitudinal direction of the second tank. The refrigerant channel is arranged so that a projection area of the refrigerant channel overlaps the tube when viewed in the longitudinal direction of the second tank.

DESCRIPTION OF EMBODIMENTS

Figure 1:
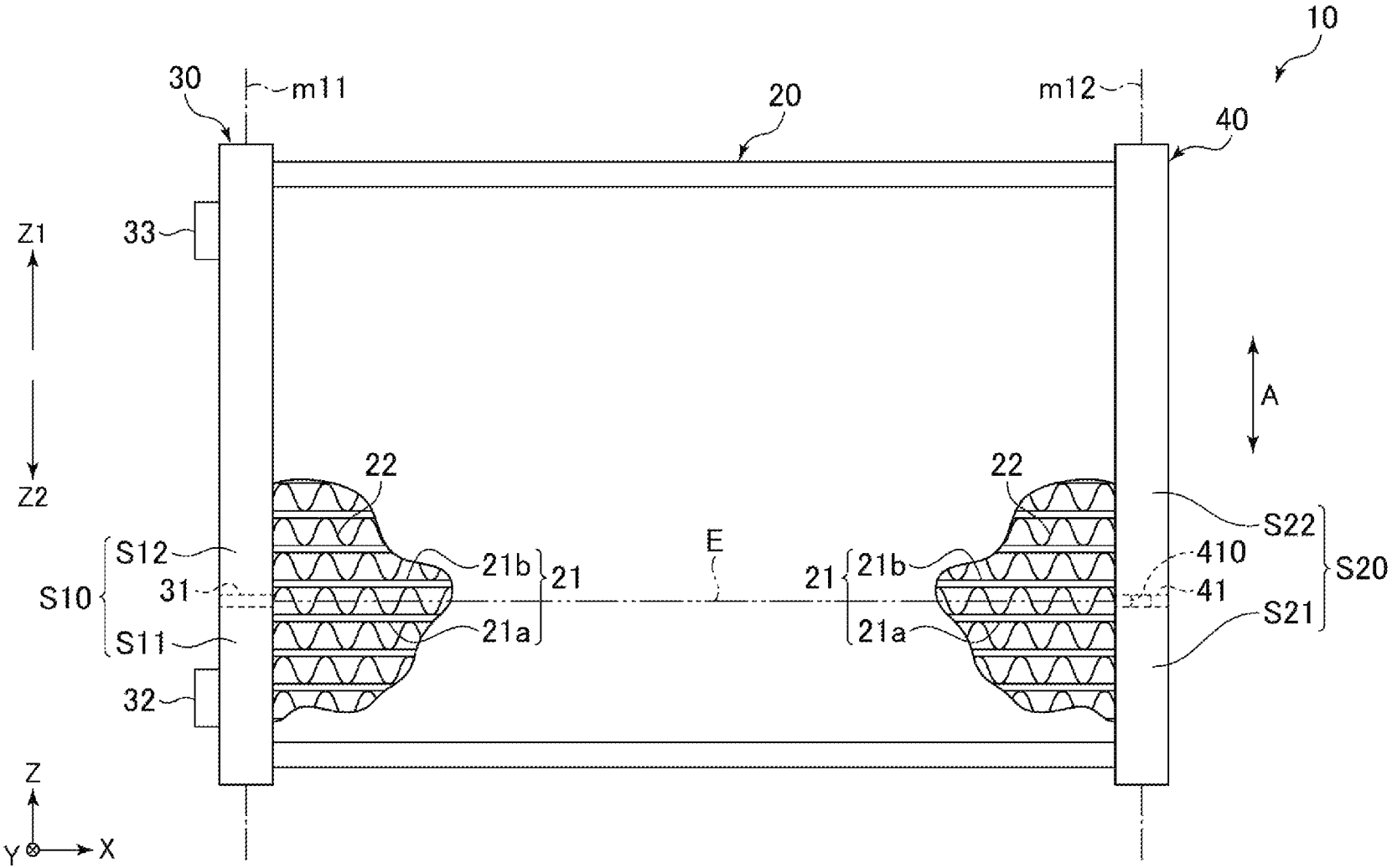
FIG. 1 is a front view illustrating a schematic configuration of a heat exchanger of a first embodiment.

To begin with, examples of relevant techniques will be described.

A heat exchanger is used as an outdoor heat exchanger of a heat pump cycle of an air conditioner for a vehicle. A refrigerant that circulates in the heat pump cycle flows through the heat exchanger. When the heat pump cycle is driven in the cooling mode, heat is exchanged between the refrigerant flowing inside and air flowing outside, such that the heat exchanger functions as a condenser for cooling the refrigerant by releasing the heat of the refrigerant to the air. When the heat pump cycle is driven in the heating mode, the heat exchanger functions as an evaporator that heats the refrigerant by absorbing the heat of the air into the refrigerant.

When the heat exchanger is operating as an evaporator, the temperature of the refrigerant needs to be lower than the temperature of the air in order for the refrigerant flowing inside the heat exchanger to absorb heat from the air. Therefore, in order for the heat exchanger to function as an evaporator in a low temperature environment, for example, when the environment temperature is 5° C. or less in winter, it is necessary for the refrigerant flowing through the heat exchanger to have a temperature lower than 5° C.

Refrigerant generally contains oil for lubricating each part of the compressor. As described above, when the temperature of the refrigerant is lowered in order to make the heat exchanger function as an evaporator, the temperature of the oil contained in the refrigerant is also lowered. The lower the temperature of the oil, the higher the viscosity of the oil. When the viscosity of the oil increases, it becomes difficult for the oil circulating in the heat pump cycle to return to the compressor, so that there is a concern that the so-called oil return property deteriorates.

In a cross-flow type heat exchanger, refrigerant flows in from the lower side in the vertical direction, and the tank is arranged so as to extend in the vertical direction. The refrigerant flows inside of the tank upward in the vertical direction. In such a tank, the oil is affected by inertial force such as gravity, so that the highly viscous oil is partially biased with respect to the vertical direction. Therefore, the oil return property is further deteriorated. It should be noted that such deterioration in the oil return property can also occur in a cross-flow type heat exchanger in which the refrigerant flows in from the upper side in the vertical direction.

If the oil return property deteriorates due to the above factors, the oil supplied to the compressor becomes insufficient. In this case, a foreign matter may be generated due to friction of each part of the compressor or seizure of the compressor may be generated.

The present disclosure provides a heat exchanger capable of ensuring oil return property even when the heat exchanger is used as a condenser and an evaporator in a heat pump cycle.

According to one aspect of the present disclosure, a heat exchanger is used as a condenser and an evaporator. A refrigerant containing oil for lubricating a compressor flows through the heat exchanger having plural tubes, a first tank, and a second tank. In the tubes, the refrigerant flows to exchange heat with air flowing outside. The first tank is shaped in a cylinder arranged to extend in a vertical direction and connected to one end of the tubes. The second tank is shaped in a cylinder arranged to extend in the vertical direction and connected to the other end of the tubes. A first internal passage and a second internal passage arranged above the first internal passage in the vertical direction are defined inside the first tank. The plural tubes includes a first tube communicated with the first internal passage of the first tank, and a second tube communicated with the second internal passage of the first tank. The refrigerant flows in order of the first internal passage of the first tank, the first tube, the second tank, the second tube, and the second internal passage of the first tank. A channel forming portion is provided inside the second tank to form a refrigerant channel having a cross-sectional area smaller than that of an internal passage of the second tank in a cross-section orthogonal to a longitudinal direction of the second tank. The refrigerant channel is arranged so that a projection area of the refrigerant channel overlaps the tube when viewed in the longitudinal direction of the second tank.

Accordingly, when the refrigerant flowing into the second tank from the first tube flows toward the second tube, the refrigerant passes through the refrigerant channel of the channel forming portion. At this time, since the cross-sectional area of the refrigerant channel is smaller than the cross-sectional area of the internal passage of the second tank, the refrigerant flowing in the second tank collides with the channel forming portion, such that the flow of the refrigerant is disturbed. As a result, the refrigerant and the oil are agitated. Even when the viscosity of the oil is high, the oil is mixed with the refrigerant, and the oil can easily enter tubes other than the downstream side tube. Therefore, it becomes easy to guide the refrigerant containing oil to the second tube. Thus, the resistance for flowing the oil to each tube becomes small, and it becomes easy to return the oil. Moreover, since the refrigerant channel is arranged so as to overlap the tube, the refrigerant that has passed through the refrigerant channel easily flows into the second tube. The refrigerant containing oil easily circulates in the heat pump cycle, by adopting a structure in which the refrigerant easily flows into the second tube in this way, so that the oil return property can be ensured.

Hereinafter, embodiments of a heat exchanger will be described with reference to the drawings. To facilitate understanding, identical elements are designated with identical symbols in the drawings where possible with the duplicate description omitted.

First Embodiment

A first embodiment of a heat exchanger will be described.

A heat exchanger 10 of the present embodiment shown in FIG. 1 is used as an outdoor heat exchanger, for example, in a heat pump cycle of an air conditioner for a vehicle. The heat pump cycle includes, for example, a compressor, a water cooling condenser, a decompressor, an expansion valve, an indoor evaporator, in addition to the heat exchanger 10 as an outdoor heat exchanger. Refrigerant pumped from the compressor circulates in the heat pump cycle. The heat pump cycle is used in the air conditioner to cool or heat air blown into the cabin.

For example, in the heat pump cycle operating in the cooling mode, high-temperature and high-pressure refrigerant discharged from the compressor flows into the heat exchanger 10. At this time, the heat exchanger 10 is driven as a condenser. That is, the heat exchanger 10 cools the refrigerant by exchanging heat between the high-temperature refrigerant flowing inside the heat exchanger 10 and air flowing outside the heat exchanger. The cooled low-temperature refrigerant is decompressed through the decompressor and then flows into the indoor evaporator. The indoor evaporator cools air by exchanging heat with the low-temperature refrigerant. The refrigerant that has passed through the indoor evaporator flows into the compressor. When the heat pump cycle is operating in the cooling mode, the refrigerant circulates in this manner.

Further, in the heat pump cycle operating in the heating mode, the heat exchanger 10 is driven as an evaporator. That is, the heat exchanger 10 heats the refrigerant by exchanging heat between the refrigerant flowing inside and air flowing outside. The heated high-temperature refrigerant is compressed by the compressor and discharged from the compressor as high-temperature and high-pressure refrigerant. The high-temperature and high-pressure refrigerant discharged from the compressor flows into the water cooling condenser. In the water cooling condenser, the engine cooling water is heated by exchanging heat with the high-temperature and high-pressure refrigerant. The heated engine cooling water exchanges heat with air in the indoor condenser of the air conditioner, so that the air is heated. The refrigerant that has passed through the water cooling condenser is expanded by the expansion valve and then flows into the heat exchanger 10. When the heat pump cycle is operating in the heating mode, the refrigerant circulates in this manner.

The refrigerant contains oil for lubricating each part of the compressor. When the refrigerant circulating in the heat pump cycle flows through the compressor, the oil contained in the refrigerant is supplied to each part of the compressor, so that each part of the compressor can be continuously lubricated.

Next, the specific structure of the heat exchanger 10 will be described.

As shown in FIG. 1, the heat exchanger 10 includes a core portion 20, a first tank 30, and a second tank 40. In the following, three axial directions orthogonal to each other are represented by the direction X, the direction Y, and the direction Z. In the present embodiment, air passes through the heat exchanger 10 in the air flow direction Y. The direction Z represents the vertical direction. Of the direction Z, the upper side Z1 indicates upward in the vertical direction, and the lower side Z2 indicates downward in the vertical direction. Further, the direction X is orthogonal to both the direction Y and the direction Z.

The core portion 20 includes plural tubes 21 and plural fins 22. In FIG. 1, only a part of the tubes 21 and the fins 22 is shown. The tubes 21 are stacked and arranged with a predetermined gap in the direction Z. The tube 21 is a flat tube having a flat direction Y, and is formed so as to extend in the direction X. A passage is defined inside the tube 21, through which the refrigerant flows, and extends in the direction X. Air flows in the direction Y in the gap between the adjacent tubes 21 and 21.

The fin 22 is arranged in the gap between the adjacent tubes 21 and 21. The fin 22 facilitates heat exchange between the refrigerant flowing inside the tube 21 and air by increasing the contact area with the air flowing in the gap between the adjacent tubes 21 and 21.

Each of the first tank 30 and the second tank 40 is formed so as to extend in the vertical direction Z. That is, in the present embodiment, the longitudinal direction A of the first tank 30 and the second tank 40 corresponds to the vertical direction Z. The first tank 30 is connected to one end of the tubes 21. The second tank 40 is connected to the other end of the tubes 21.

The first tank 30 is formed in a substantially cylindrical shape with an axis m11 parallel to the vertical direction Z. The internal space of the first tank 30 forms a passage through which the refrigerant flows. The opening at the one end of the tube 21 is located inside the first tank 30. As a result, the internal passage of the tube 21 and the internal passage S10 of the first tank 30 are communicated with each other.

The first tank 30 includes a partition plate 31 that partitions the internal passage S10 into the first internal passage S11 and the second internal passage S12. The second internal passage S12 is located on the upper side Z1 in the vertical direction with respect to the first internal passage S11. In FIG. 1, the position corresponding to the partition plate 31 in the core portion 20 is illustrated by the double chain line E. In the following, among the tubes 21, the tubes located on the lower side Z2 in the vertical direction relative to the double chain line E is referred to as the first tube 21*a*, and the tubes located on the upper side Z1 in the vertical direction relative to the double chain line E is referred to as the second tube 21*b*. The first tube 21*a* is communicated with the first internal passage S11 of the first tank 30. The second tube 21*b* is communicated with the second internal passage S12 of the first tank 30.

As shown in FIG. 1, the first tank 30 has an inflow port 32 into which the refrigerant flows in and an outflow port 33 from which the refrigerant flows out. The inflow port 32 is communicated with the first internal passage S11 of the first tank 30. The outflow port 33 is communicated with the second internal passage S12 of the first tank 30. The inflow port 32 is arranged at the lower side in the vertical direction in the heat exchanger 10 of the present embodiment to improve the distribution of the refrigerant to the second tube 21*b*. Thus, the amount of liquid phase refrigerant supplied to each of the second tubes 21*b* can be made uniform.

The second tank 40 is formed in a cylindrical shape with the axis m12. The internal passage S20 of the second tank 40 communicates with the internal passages of the first tube 21*a* and the second tube 21*b*. As shown in FIG. 1, a channel forming portion 41 is provided in the second tank 40 at a position corresponding to the partition plate 31 of the first tank 30.

Figure 2:
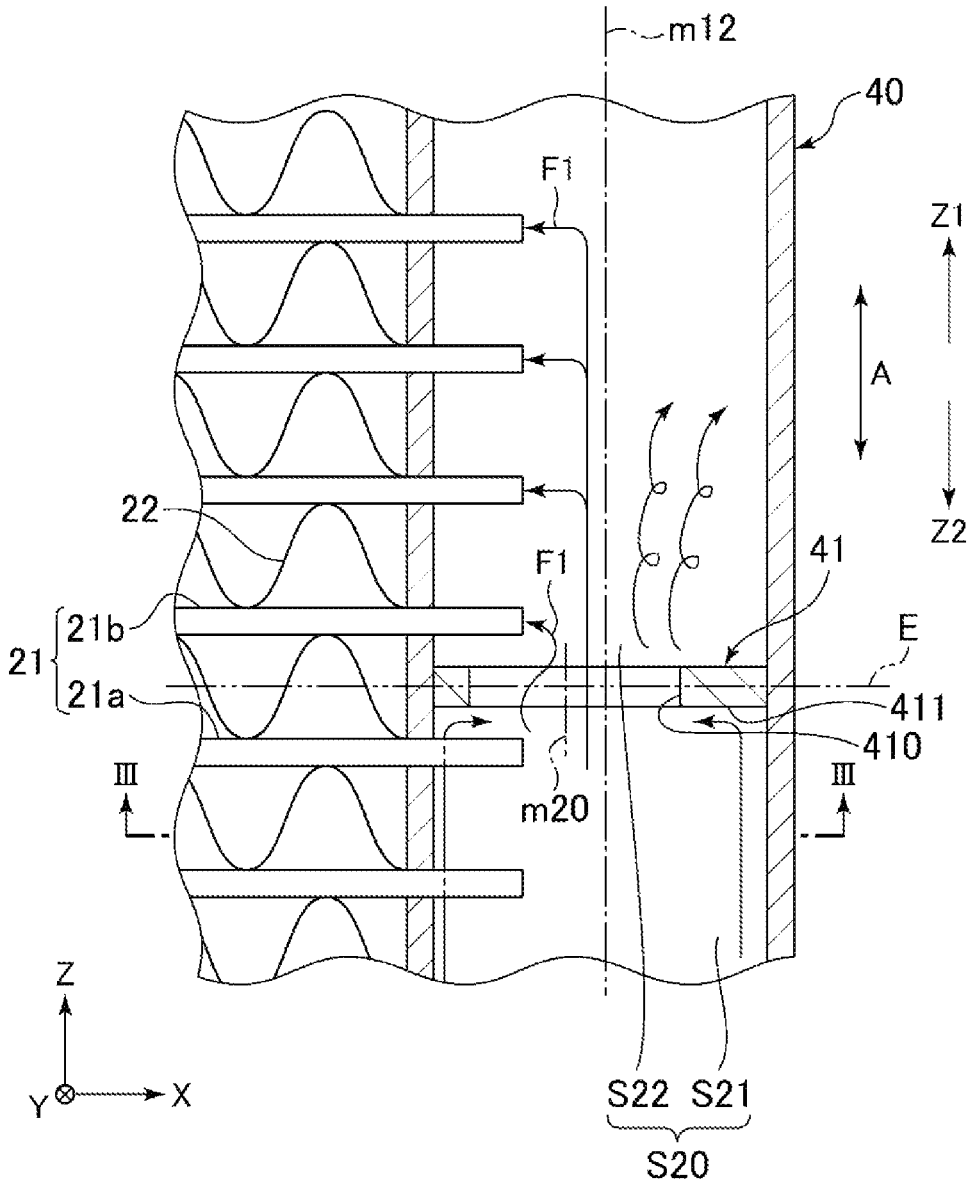
FIG. 2 is a cross-sectional view illustrating a channel forming portion in a second tank of the first embodiment.
Figure 3:
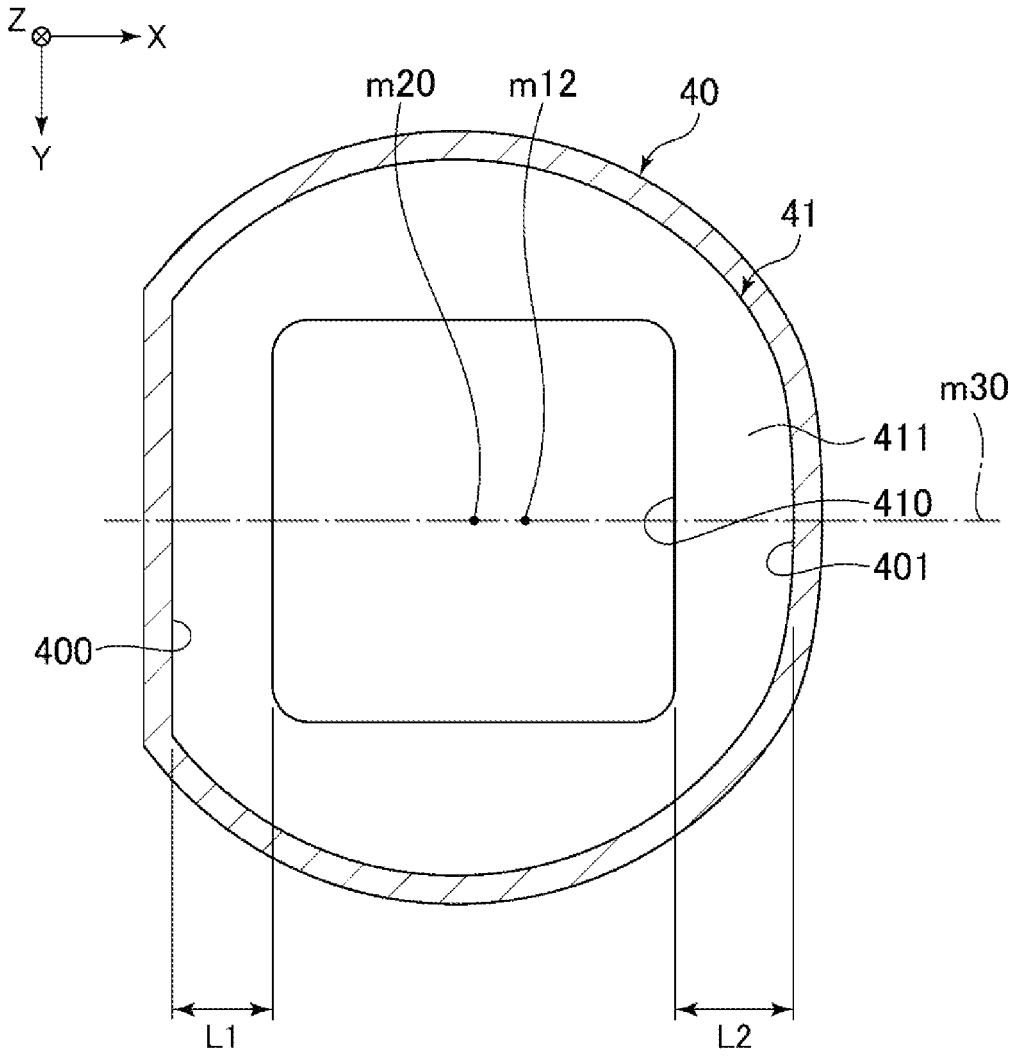
FIG. 3 is a cross-sectional view taken along a line III-III in FIG. 2.

As shown in FIG. 2, the channel forming portion 41 is made of a plate-shaped member. The internal passage S20 of the second tank 40 has the first internal passage S21 located on the lower side Z2 in the vertical direction with respect to the channel forming portion 41, and the second internal passage S22 located on the upper side Z1 in the vertical direction with respect to the channel forming portion 41. The channel forming portion 41 has a refrigerant channel 410 that communicates the first internal passage S21 and the second internal passage S22 with each other. The refrigerant channel 410 is formed so as to extend in the vertical direction Z. Further, as shown in FIG. 3, the refrigerant channel 410 is formed to have a square shape in the cross-section orthogonal to the longitudinal direction A of the second tank 40. The refrigerant channel 410 has a cross-sectional area smaller than that of the internal passage S20 of the second tank 40 in the cross-section orthogonal to the longitudinal direction A of the second tank 40. In FIG. 3, the inner wall surface of the second tank 40 has a first portion 400 into which the tube 21 is inserted. Further, the inner wall surface of the second tank 40 has a second portion 401 located on the opposite side of the first portion 400 across the central axis m12 of the second tank 40.

As shown in FIG. 2, the refrigerant channel 410 is arranged so that the projection area overlaps with the tube 21 when viewed from the longitudinal direction A of the second tank 40. Further, the central axis m20 of the refrigerant channel 410 is deviated from the central axis m12 of the second tank 40 toward the tube 21. As a result, as shown in FIG. 3, the refrigerant channel 410 is arranged so that a length L2 of the wall surface of the channel forming portion 41 from the second portion 401 to the refrigerant channel 410 is larger than a length L1 of the wall surface of the channel forming portion 41 from the first portion 400 to the refrigerant channel 410 on the axis m30 passing through the central axis of the second tank 40 and parallel to the flow direction in the tube 21. That is, the relation "L1<L2" is established in FIG. 3.

Next, an operation example of the heat exchanger 10 of the present embodiment will be described.

In the heat exchanger 10, the refrigerant that has flowed into the first internal passage S11 of the first tank 30 through the inflow port 32 is distributed from the first internal passage S11 to the first tubes 21*a*. Then, heat is exchanged between the refrigerant flowing inside the first tube 21*a* and air flowing outside the first tube 21*a*. The refrigerant flowing through the first tubes 21*a* is collected in the first internal passage S21 of the second tank 40. The refrigerant collected in the first internal passage S21 of the second tank 40 flows through the refrigerant channel 410 of the channel forming portion 41 into the second internal passage S22 of the second tank 40 and is distributed to the second tubes 21*b*. Then, heat is exchanged further between the refrigerant flowing inside the second tube 21*b* and air flowing outside the second tube 21*b*. The refrigerant flowing through the second tubes 21*b* is collected in the second internal passage S22 of the first tank 30, and then discharged from the outflow port 33. As described above, in the heat exchanger 10, refrigerant flows in order of the first internal passage S11 of the first tank 30, the first tube 21*a*, the second tank 40, the second tube 21*b*, and the second internal passage S12 of the first tank 30.

When the heat exchanger 10 functions as an evaporator, the temperature of the refrigerant needs to be lower than the temperature of the air in order to heat the refrigerant with the air. Therefore, in order for the heat exchanger 10 to function as an evaporator in a low temperature environment, for example, when an environment temperature is 5° C. or less in winter, the temperature of the refrigerant flowing through the heat exchanger 10 needs to have a temperature lower than 5° C. When such a low-temperature refrigerant flows through the heat exchanger 10, the viscosity of the oil contained in the refrigerant increases.

When the viscosity of the oil becomes high, it becomes difficult for the oil to flow from the second tank 40 to the second tubes 21*b*, in the so-called cross-flow heat exchanger 10 of the present embodiment, in which the first tank 30 and the second tank 40 are arranged to extend in the vertical direction Z, and the flow direction in the tube 21 is orthogonal to the air flow direction Y.

Specifically, the liquid-phase refrigerant, the gas-phase refrigerant and the oil are mixed and flow in the internal passage S20 of the second tank 40 to the upper side Z1 in the vertical direction. Since the liquid-phase refrigerant and the oil have a higher density than the gas-phase refrigerant, the liquid-phase refrigerant and the oil cling to the inner wall of the second tank 40 and flow due to the influence of the inertial force. Therefore, the liquid-phase refrigerant and oil are difficult to enter the tube located at middle of the second tubes 21*b*. In other words, the liquid-phase refrigerant and the oil easily flow into the downstream tube, unevenly, among the second tubes 21*b*, on the upper side Z1 in the vertical direction. Further, the bias in the inflow amount of oil among the second tubes 21*b* also changes depending on the viscosity of the oil. That is, when the viscosity of the oil is low, the oil flows to the upper side Z1 in the vertical direction together with the liquid-phase refrigerant. Therefore, the refrigerant containing the oil easily flows through the entire second tubes 21*b* even if an inertial force acts on the liquid-phase refrigerant and the oil. However, when the viscosity of the oil becomes high, the liquid-phase refrigerant and the oil tend to flow unevenly to the upper side Z1 in the vertical direction of the second tank 40 due to the inertial force. In this case, among the second tubes 21*b*, the oil unevenly flows into several tubes arranged on the upper side Z1 in the vertical direction, so that it becomes difficult to push the oil out of the tubes. As a result, it becomes difficult for the oil to flow from the second tank 40 to the second tube 21*b*.

In this respect, in the heat exchanger 10 of the present embodiment, when the refrigerant flowing from the first tube 21*a* into the second tank 40 flows toward the second tube 21*b*, the refrigerant passes through the refrigerant channel 410 of the channel forming portion 41. At this time, since the cross-sectional area of the refrigerant channel 410 is smaller than the cross-sectional area of the internal passage S20 of the second tank 40, the liquid-phase refrigerant and oil flowing to the upper side Z1 in the vertical direction in the first internal passage S21 of the second tank 40 collide with the bottom surface 411 of the channel forming portion 41. At this time, the liquid-phase refrigerant and the oil that flow and cling to the inner wall of the second tank 40 due to the high density are collected in the refrigerant channel 410. Since the flow velocity of the refrigerant is high in the refrigerant channel 410, the flow of the liquid-phase refrigerant and the oil is disturbed. As a result, the liquid-phase refrigerant and the oil are agitated, so that the oil can easily flow uniformly over the entire second tubes 21*b* even when the viscosity of the oil is high. As shown by arrow directions F1 in FIG. 2, the refrigerant containing the oil flows through the refrigerant channel 410 to the second internal passage S22 of the second tank 40, so that the refrigerant containing the oil is easily transferred to the second tubes 21*b*.

Figure 4:
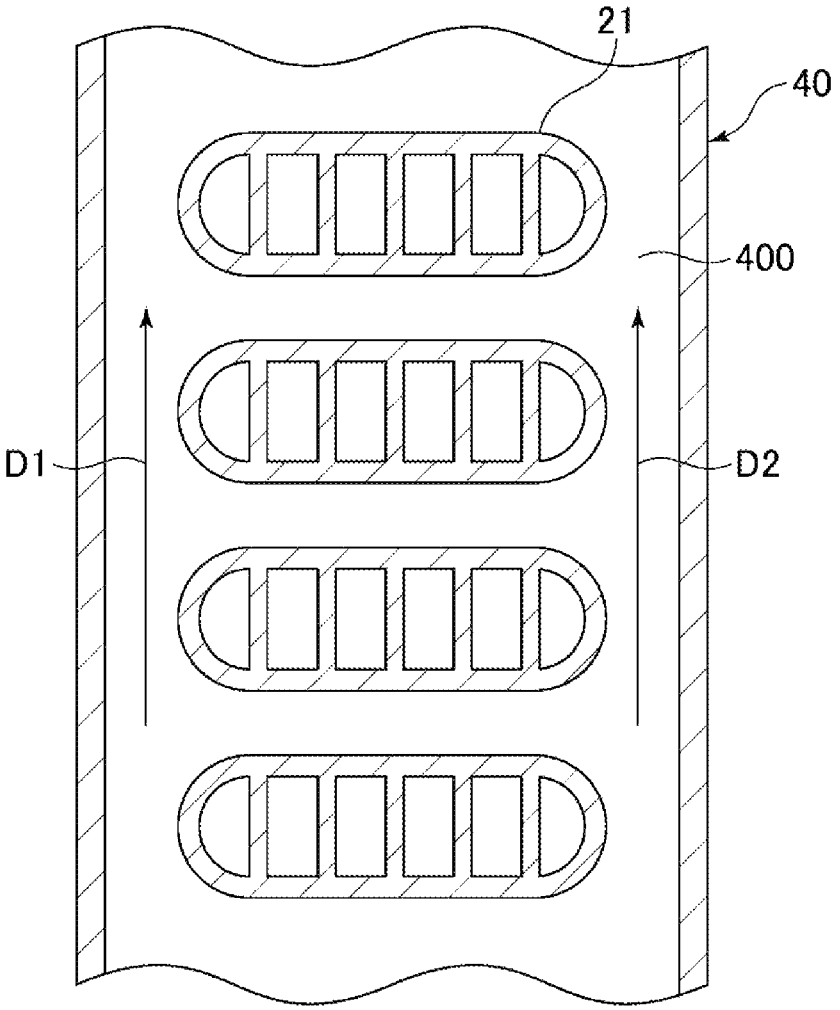
FIG. 4 is a cross-sectional view illustrating the second tank of the first embodiment.

According to experiments by the inventors, in the first internal passage S21 of the second tank 40, as shown by arrow directions D1 and D2 in FIG. 4, it has been confirmed that a high-density liquid-phase refrigerant and oil flow and cling to the inner wall surface of the second tank 40 along both sides of the tube 21. Therefore, the liquid-phase refrigerant and the oil easily collide with the channel forming portion 41 while flowing by sticking to the inner wall surface of the second tank 40 along both sides of the tube 21, as shown in FIGS. 2 and 3, since the channel forming portion 41 is formed inside the second tank 40. That is, since the main flow of the liquid-phase refrigerant and the oil in the first internal passage S21 of the second tank 40 collides with the bottom surface 411 of the channel forming portion 41, the flow of the liquid-phase refrigerant and the oil is further disturbed. Therefore, since the refrigerant containing the oil easily flows into the second internal passage S22 of the second tank 40 through the refrigerant channel 410, it is easier to guide the refrigerant containing the oil to the second tubes 21*b*.

According to the heat exchanger 10 of the present embodiment, effects described in the following items (1) to (5) can be obtained.

(1) In the heat exchanger 10, the liquid-phase refrigerant in the second tank 40 collides with the bottom surface 411 of the channel forming portion 41, so that the flow of the liquid-phase refrigerant and the oil is disturbed. As a result, even when the viscosity of the oil is high, the liquid-phase refrigerant and the oil are agitated, so that the oil can be easily guided to the entire second tubes 21*b*. Moreover, in the heat exchanger 10, since the refrigerant channel 410 of the channel forming portion 41 is arranged so as to overlap the second tube 21*b*, the refrigerant that has passed through the refrigerant channel 410 easily flows into the second tube 21*b*. The refrigerant containing the oil easily circulates in the heat pump cycle by adopting a structure in which the refrigerant easily flows into the second tube 21*b* in this way, so that the oil return property can be ensured.

(2) In the second tank 40, when the channel forming portion 41 is not formed, the refrigerant flowing into the first internal passage S21 from the first tube 21*a* does not collide with the channel forming portion 41 and flows upward in the vertical direction. Therefore, the liquid-phase refrigerant, which is more affected by the inertial force because of its higher density, is more likely to flow into the second tube 21*b* arranged on the upper side Z1 in the vertical direction. That is, a flow rate distribution is formed among the second tubes 21*b*. The amount of the refrigerant increases as located on the upper side Z1 in the vertical direction. Such variations in the flow rate distribution of the refrigerant among the second tubes 21*b* are factors that reduce the endothermic efficiency when the heat exchanger 10 functions as an evaporator.

In this regard, in the heat exchanger 10 of the present embodiment, the liquid-phase refrigerant and the oil in the second tank 40 collide with the bottom surface 411 of the channel forming portion 41, causing disturbance in the flow of the liquid-phase refrigerant and the oil. Of the second tubes 21*b* connected to the second internal passage S22 of the second tank 40, the refrigerant easily flows into the second tube 21*b* near the channel forming portion 41, due to the turbulence in the flow of the liquid-phase refrigerant and the oil. As a result, the variation in the flow rate distribution of the refrigerant among the second tubes 21*b* can be alleviated, so that the endothermic efficiency of the heat exchanger 10 can be improved. According to the experiments by the inventors, it has been confirmed that the heat absorption performance of the heat exchanger 10 is improved by 15% under the conditions that the outside air temperature is −10° C., the humidity is below the open air, the air velocity is 2 m/s, the refrigerant is R134a, the refrigerant pressure at the inflow port 32 is 0.15 MPa_abs, the temperature of the super heat portion of the outflow port 33 is 2° C., the width of the core portion 20 is 680 mm, and the height of the core portion 20 is 376.2 mm.

(3) When the flow rate distribution of the refrigerant among the second tubes 21*b* varies, the temperature distribution among the second tubes 21*b* also tends to vary. Therefore, when the heat exchanger 10 is operating at a low temperature, frost is likely to be formed in concentrated manner in the low-temperature second tube 21*b*. As a result, when thick frost is formed on a part of the second tube 21*b*, heat exchange with air is not performed at that part. This is a factor that causes a decrease in the performance of the heat exchanger 10. In this regard, in the heat exchanger 10 of the present embodiment, as described above, the variation in the flow rate distribution of the refrigerant among the second tubes 21*b* can be alleviated. Therefore, frost is likely to be formed uniformly on the core portion 20 when the heat exchanger 10 is driven at a low temperature. As a result, it is possible to avoid a situation in which heat exchange is not performed at all in a part of the second tube 21*b*. Thus, the heat absorption performance of the heat exchanger 10 can be easily ensured.

(4) The refrigerant channel 410 is arranged such that the wall length L2 of the channel forming portion 41 from the second portion 401 of the inner wall surface of the second tank 40 to the refrigerant channel 410 is longer than the wall length L1 of the channel forming portion 41 from the first portion 400 of the inner wall surface of the second tank 40 to the refrigerant channel 410, on the axis m30 passing through the central axis of the second tank 40 and parallel to the flow direction in the tube 21. Accordingly, the flow direction of the liquid-phase refrigerant and the oil passing through the refrigerant channel 410 of the channel forming portion 41 can be easily directed toward the tube 21, so that the liquid-phase refrigerant and the oil easily collide with the tube 21. When the liquid-phase refrigerant and the oil collide with the tube 21, the flow of the liquid-phase refrigerant and the oil is more likely to be disturbed, so that the liquid-phase refrigerant and the oil are more easily agitated. As a result, the oil is more easily mixed with the refrigerant, so that the refrigerant containing the oil can be more easily guided from the second tank 40 to the second tube 21*b*.

(5) The refrigerant channel 410 is formed to have a rectangular shape in the cross-section orthogonal to the longitudinal direction A of the second tank 40. Accordingly, the flow velocity of the refrigerant flowing in the refrigerant channel 410 can be made non-uniform, so that the flow of the liquid-phase refrigerant and the oil is more likely to be disturbed. That is, since the liquid-phase refrigerant and the oil are more easily agitated, the refrigerant containing the oil is more easily guided from the second tank 40 to the second tube 21*b*.

(Modifications)

Next, modifications of the heat exchanger 10 of the first embodiment will be described. The shape of the refrigerant channel 410 formed in the channel forming portion 41 can be changed, for example, as shown in FIGS. 5 to 10.

Figure 5:
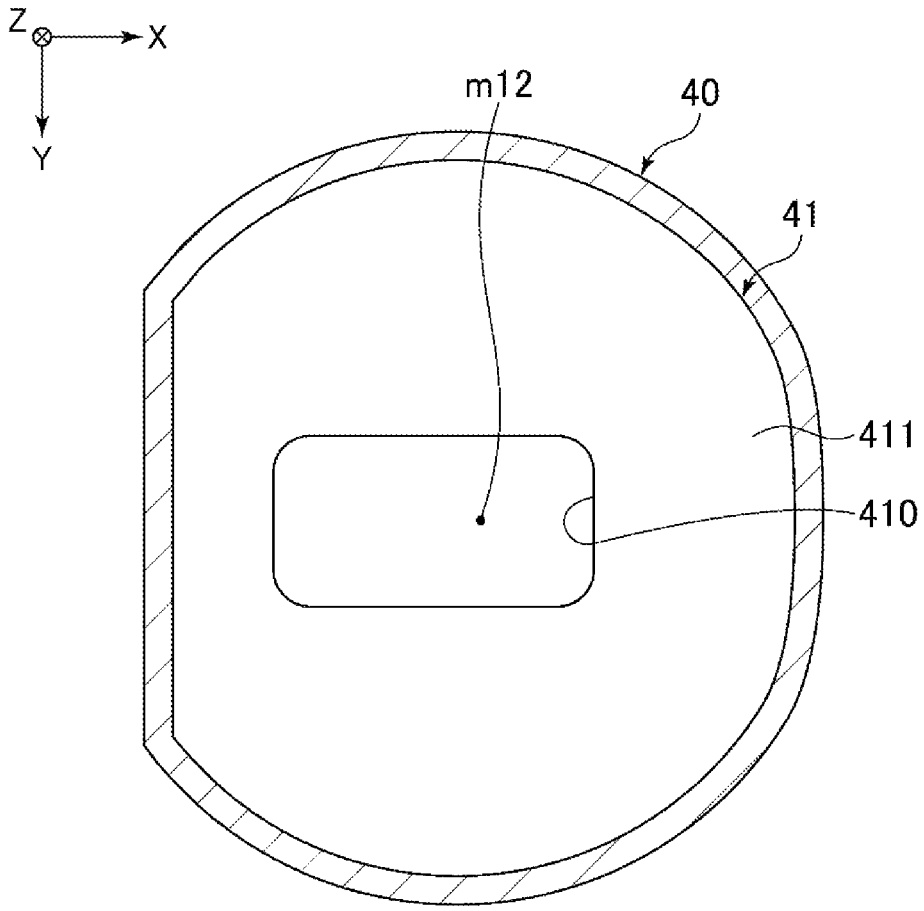
FIG. 5 is a cross-sectional view illustrating a second tank of a modification of the first embodiment.

The refrigerant channel 410 shown in FIG. 5 is formed to have a shape elongated in the extending direction of the tube 21, in the cross-section orthogonal to the longitudinal direction A of the second tank 40.

Figure 6:
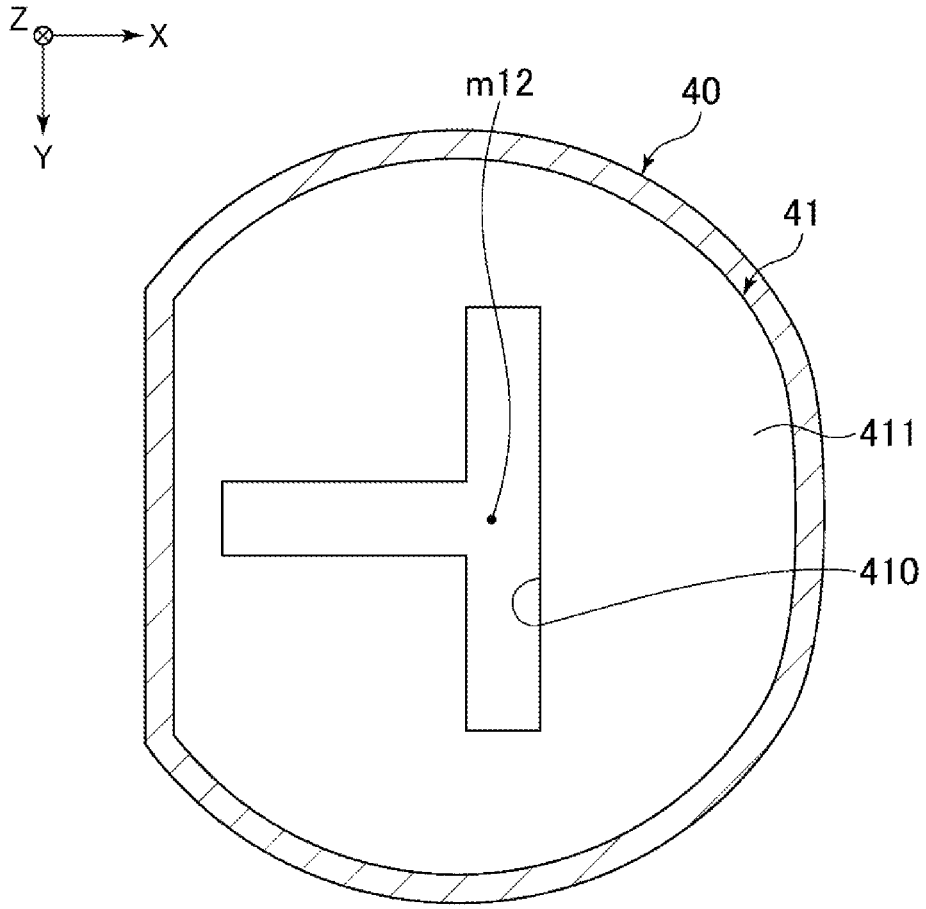
FIG. 6 is a cross-sectional view illustrating a second tank of a modification of the first embodiment.

The refrigerant channel 410 shown in FIG. 6 is formed to have T-shape in the cross-section orthogonal to the longitudinal direction A of the second tank 40.

Figure 7:
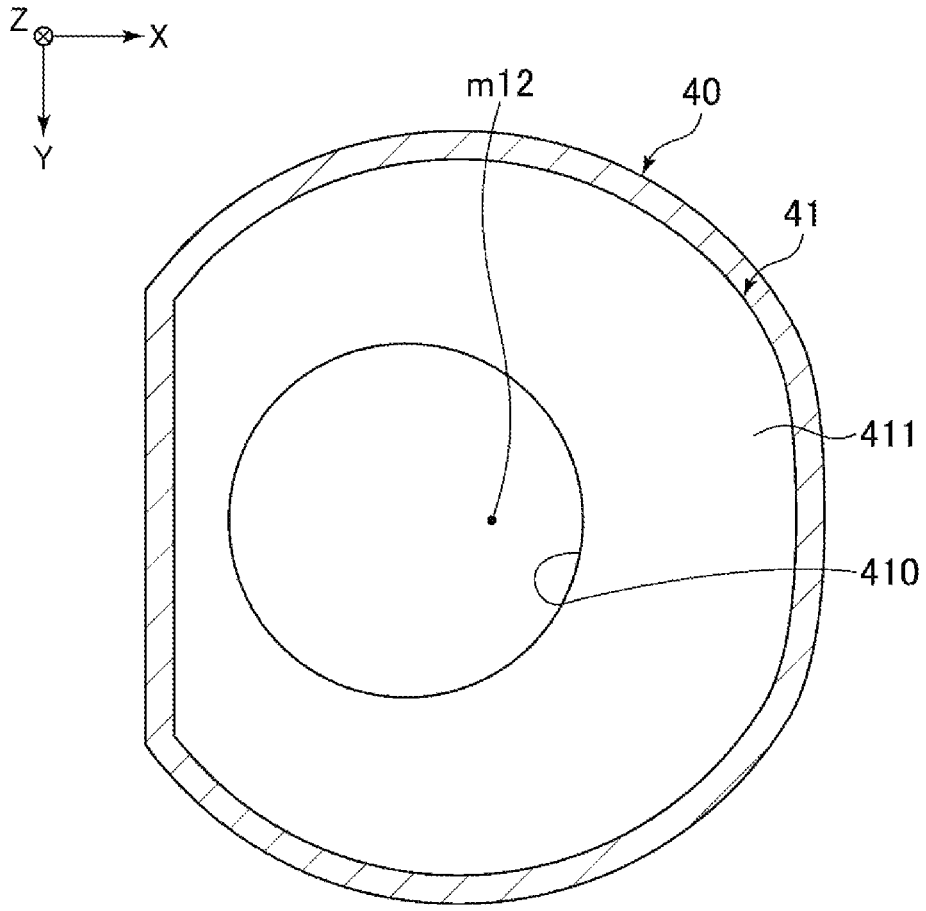
FIG. 7 is a cross-sectional view illustrating a second tank of a modification of the first embodiment.

The refrigerant channel 410 shown in FIG. 7 is formed to have a circular shape in the cross-section orthogonal to the longitudinal direction A of the second tank 40.

Figure 8:
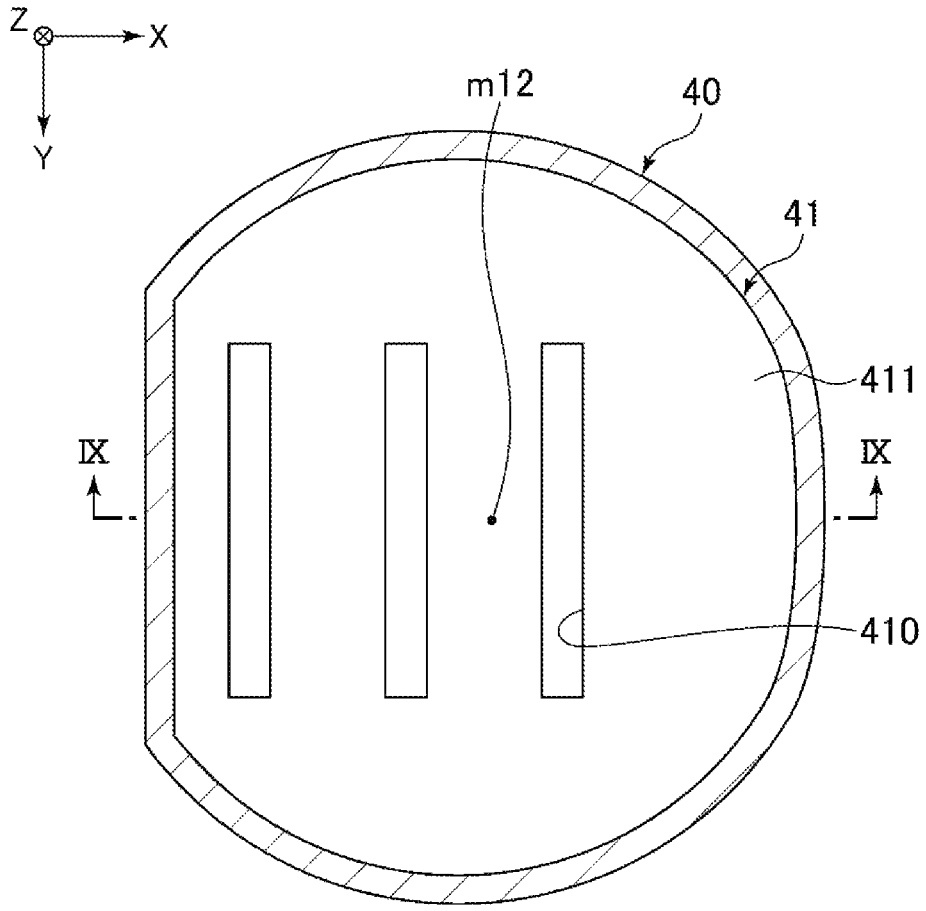
FIG. 8 is a cross-sectional view illustrating a second tank of a modification of the first embodiment.
Figure 9:
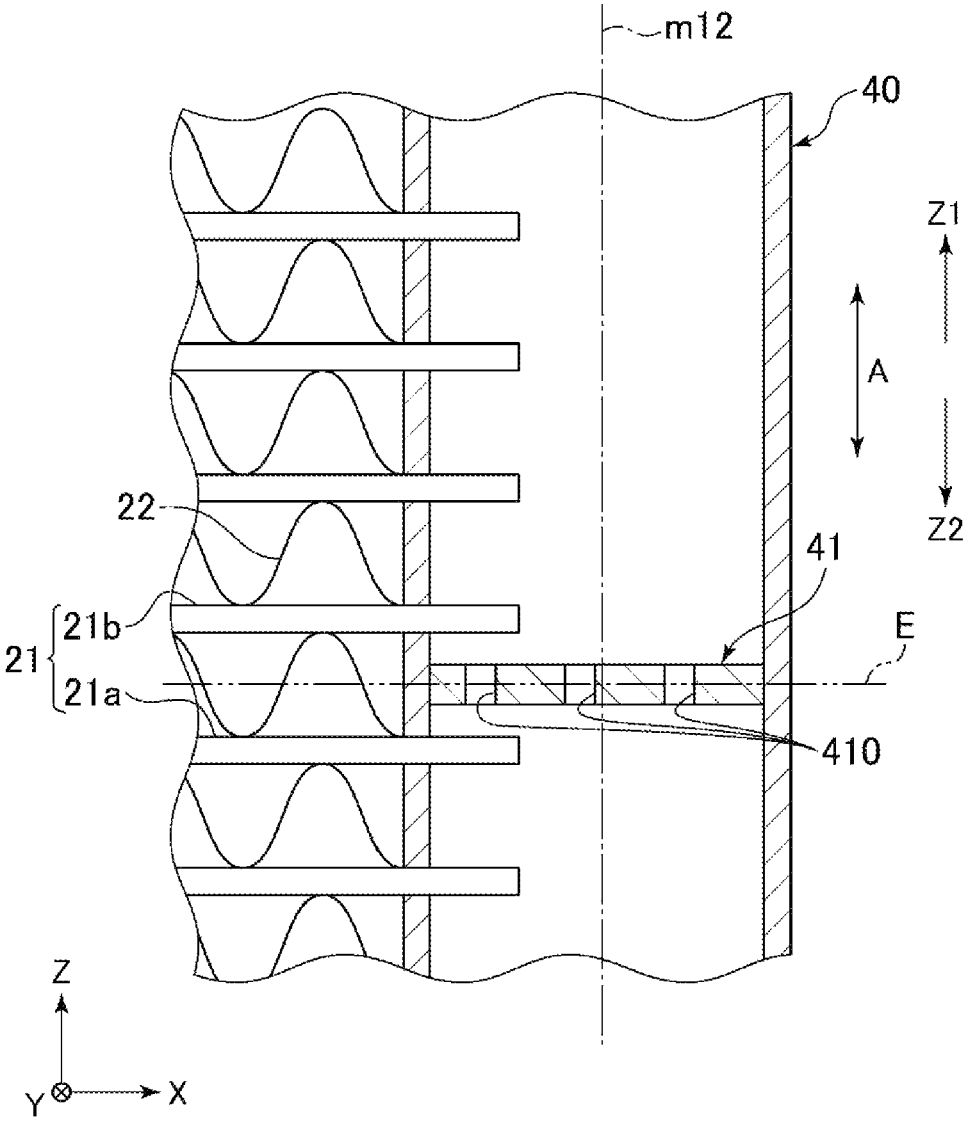
FIG. 9 is a cross-sectional view taken along a line IX-IX in FIG. 8.

The refrigerant channel 410 shown in FIGS. 8 and 9 is formed to have a slit shape in the cross-section orthogonal to the longitudinal direction A of the second tank 40. The channel forming portion 41 has plural slit-shaped refrigerant channels 410 arranged in parallel at a predetermined interval.

Figure 10:
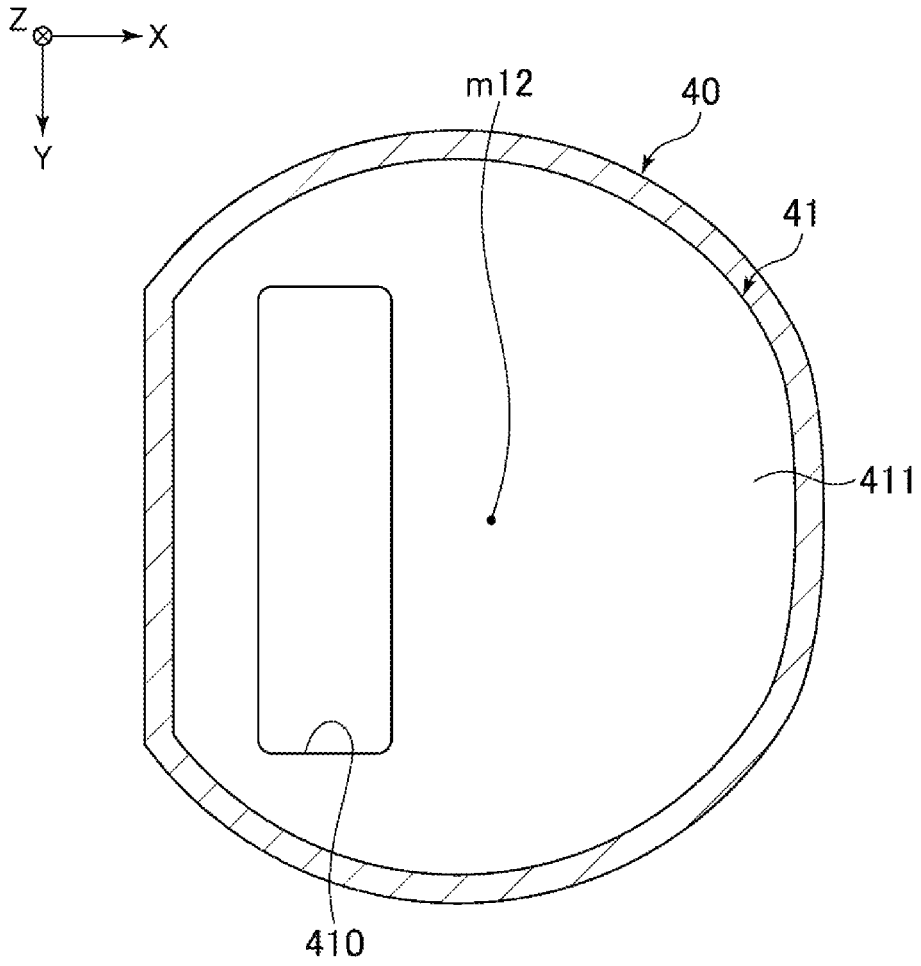
FIG. 10 is a cross-sectional view illustrating a second tank of a modification of the first embodiment.

The refrigerant channel 410 shown in FIG. 10 is formed to have a shape elongated in the flat direction of the tube 21 in the cross-section orthogonal to the longitudinal direction A of the second tank 40.

According to experiments by the inventors, it has been confirmed that higher oil return property can be obtained by adopting the structure shown in FIG. 10 for the channel forming portion 41, due to the following reasons. When the structure shown in FIG. 10 is adopted for the channel forming portion 41, the shape of the refrigerant channel 410 can correspond to the shape of the tube 21, so that the liquid-phase refrigerant and the oil that have passed through the refrigerant channel 410 can easily collide with the tube 21. When the liquid-phase refrigerant and the oil collide with the tube, the flow of the liquid-phase refrigerant and the oil can be further disturbed, so that the stirring of the liquid-phase refrigerant and the oil is further promoted. Therefore, the refrigerant containing the oil can be more easily guided to the second tube 21*b*, so that the oil return property can be improved.

Second Embodiment

Next, a second embodiment of the heat exchanger 10 will be described. Hereinafter, the differences from the heat exchanger 10 of the first embodiment will be mainly described.

Figure 11:
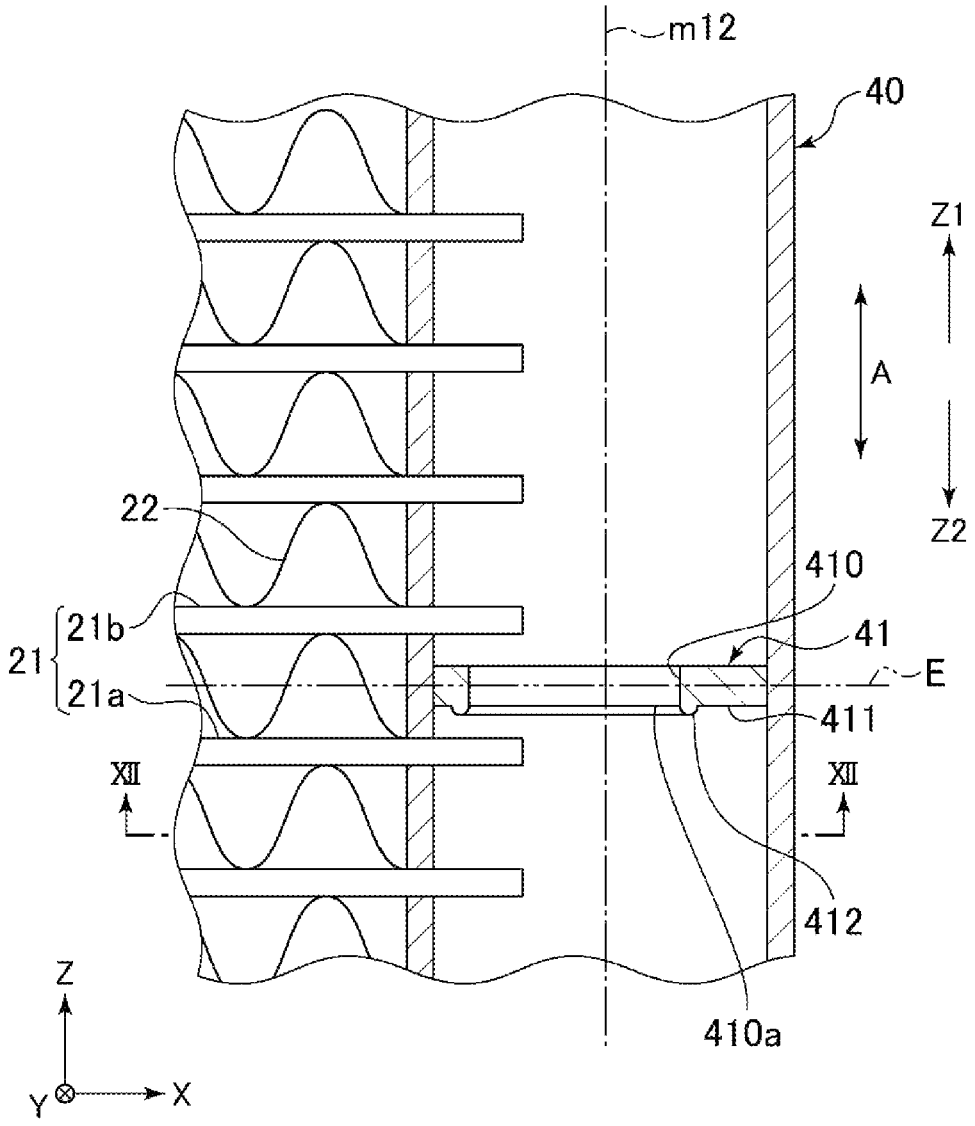
FIG. 11 is a cross-sectional view illustrating a channel forming portion in a second tank according to a second embodiment.
Figure 12:
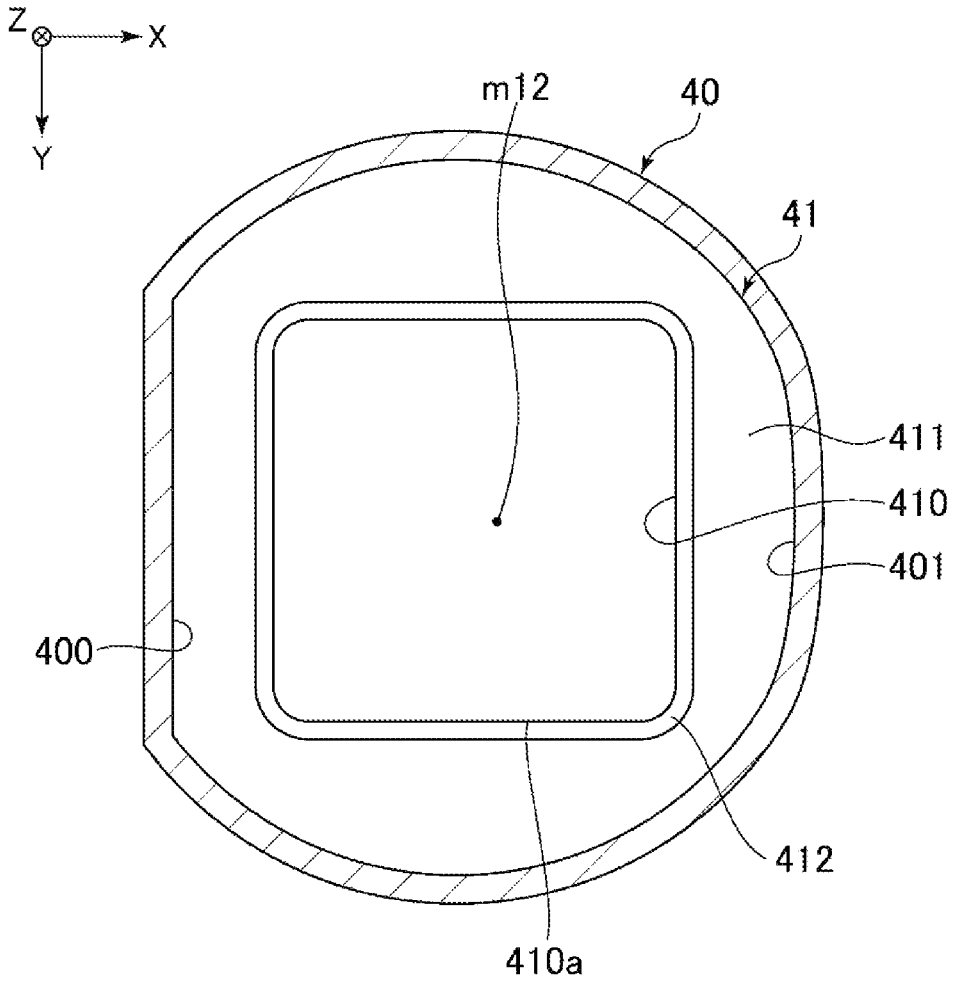
FIG. 12 is a cross-sectional view taken along a line XII-XII in FIG. 11.

As shown in FIGS. 11 and 12, a convex portion 412 is formed on the channel forming portion 41 of the present embodiment, and located around the opening end portion of the refrigerant channel 410. More specifically, the convex portion 412 is formed on the bottom surface 411 of the channel forming portion 41 adjacent to the opening end 410*a* at the inflow side of the refrigerant channel 410.

According to the heat exchanger 10 of the present embodiment, the following effects (6) can be further obtained.

(6) The convex portion 412 can increase the distance where the liquid-phase refrigerant and the oil are mixed with refrigerant having a high flow velocity flowing through the refrigerant channel 410, so as to increase the disturbance in the flow of the liquid-phase refrigerant and the oil. Since the convex portion 412 is provided on the bottom surface 411 of the channel forming portion 41, the liquid-phase refrigerant and the oil collide with the convex portion 412 when flowing toward the refrigerant channel 410 along the bottom surface 411 of the channel forming portion 41. As a result, the flow of the liquid-phase refrigerant and the oil can be further disturbed, so that the stirring of the liquid-phase refrigerant and the oil is further promoted. Therefore, the refrigerant containing the oil easily flows from the second internal passage S22 of the second tank 40 to the second tube 21*b* after passing through the refrigerant channel 410. Thus, the oil return property can be improved.

Third Embodiment

Next, the heat exchanger 10 of the third embodiment will be described. Hereinafter, the differences from the heat exchanger 10 of the first embodiment will be mainly described.

Figure 13:
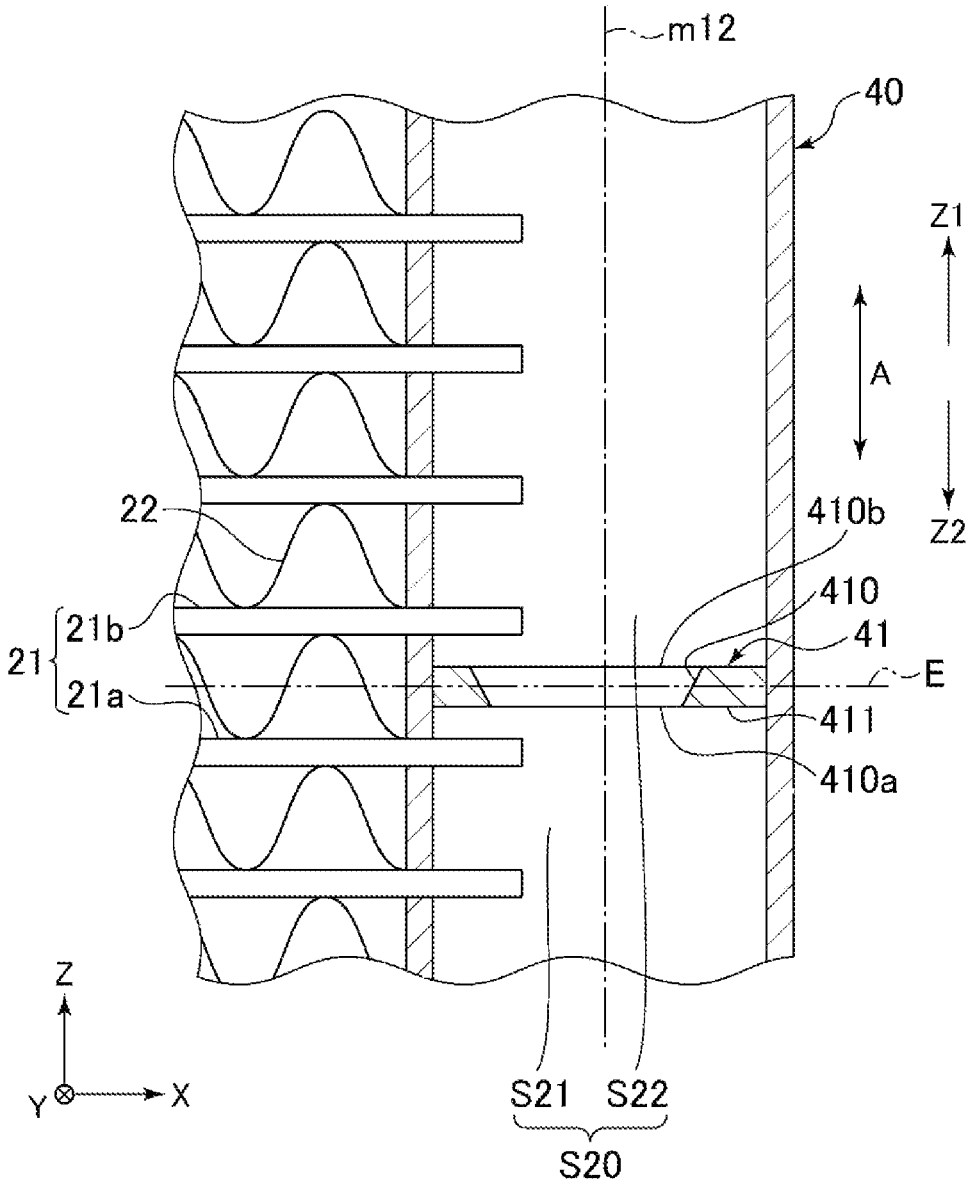
FIG. 13 is a cross-sectional view illustrating a channel forming portion in a second tank according to a third embodiment.

As shown in FIG. 13, the inner wall surface of the refrigerant channel 410 of the present embodiment is formed in a tapered shape where a passage cross-sectional area of the refrigerant channel 410 is increased from the opening end 410*a* on the inflow side toward the opening end 410*b* on the outflow side.

According to the heat exchanger 10 of the present embodiment, the following effects (7) can be further obtained.

(7) In the heat exchanger 10 of the present embodiment, the liquid-phase refrigerant and the oil flowing into the refrigerant channel 410 from the first internal passage S21 of the second tank 40 is further disturbed by the gradual increase in the cross-sectional area. Therefore, since the stirring of the liquid-phase refrigerant and the oil is further promoted, the refrigerant containing the oil easily flows from the second internal passage S22 of the second tank 40 to the second tube 21*b* after passing through the refrigerant channel 410. Therefore, it is possible to improve the oil return property.

Fourth Embodiment

Next, the heat exchanger 10 of the fourth embodiment will be described. Hereinafter, the differences from the heat exchanger 10 of the first embodiment will be mainly described.

Figure 14:
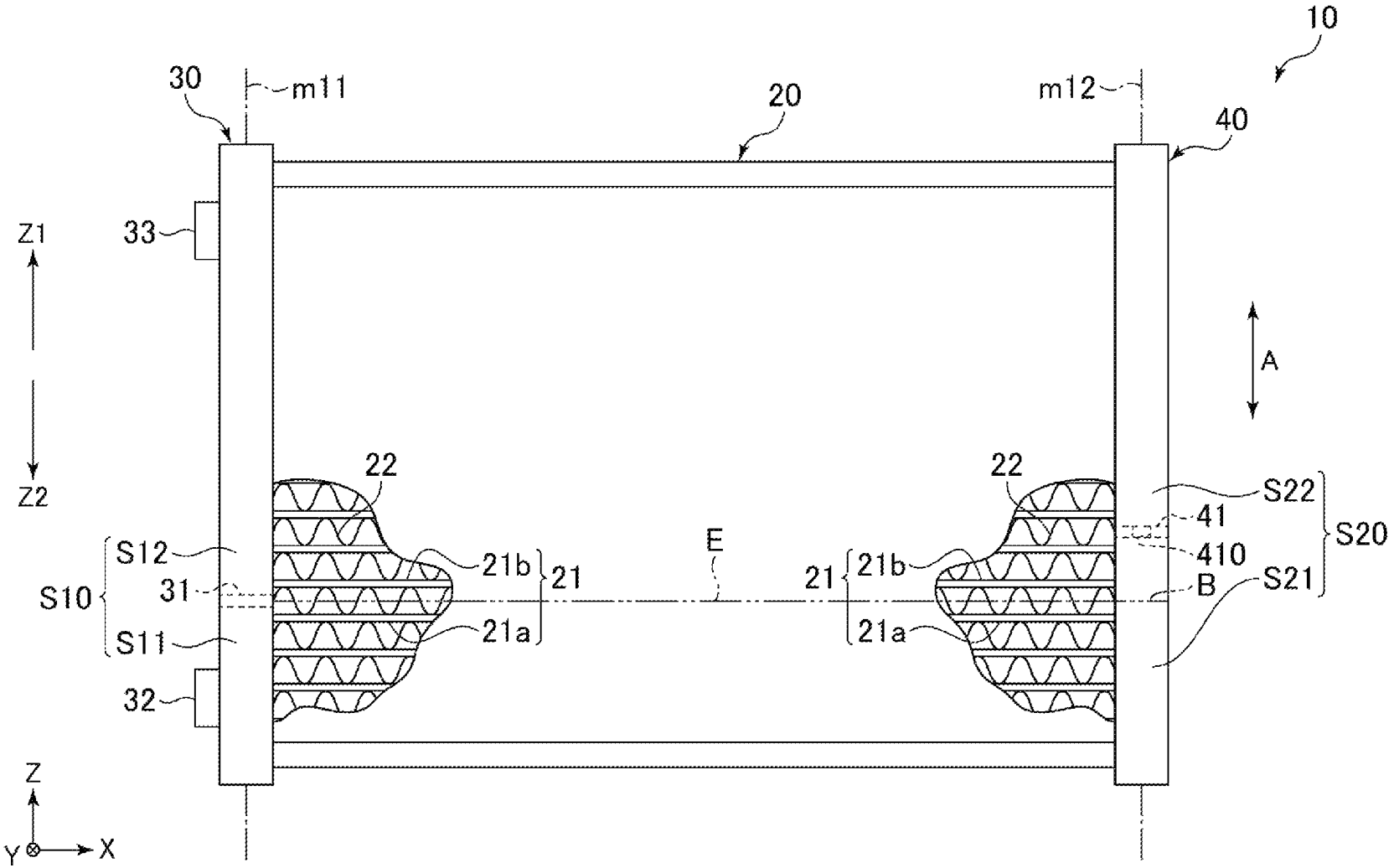
FIG. 14 is a front view illustrating a schematic configuration of a heat exchanger of a fourth embodiment.
Figure 15:
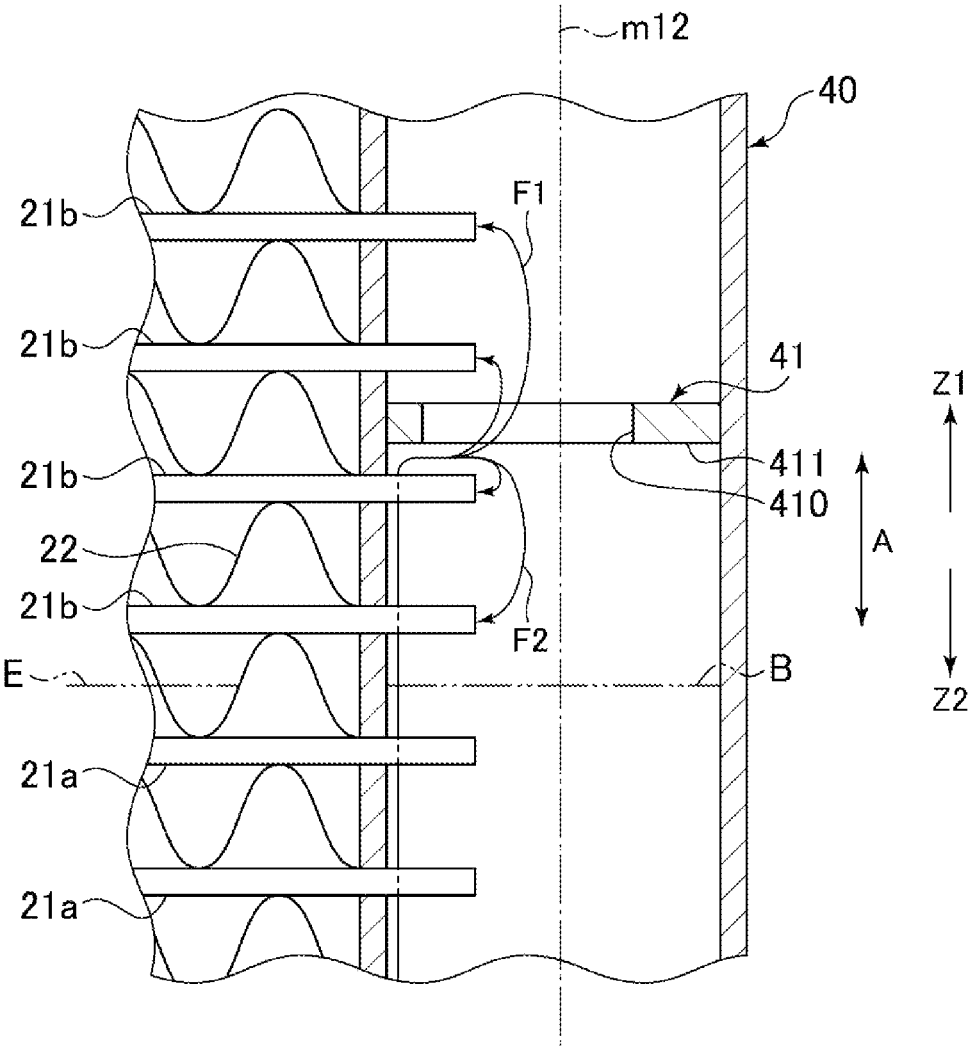
FIG. 15 is a cross-sectional view illustrating a channel forming portion in a second tank of the fourth embodiment.

As shown in FIGS. 14 and 15, in the heat exchanger 10 of the present embodiment, the channel forming portion 41 is located on the upper side Z1 in the vertical direction with respect to the channel forming portion 41 of the first embodiment.

Specifically, in the second tank 40, the liquid-phase refrigerant and the oil that have flowed from the first tube 21*a* into the first internal passage S21 flow into the second tube 21*b* by turning back from the second internal passage S22. Therefore, in the second tank 40, the boundary portion B between the area connected to the first tube 21*a* and the area connected to the second tube 21*b* is a turning-back portion in the flow of the refrigerant. The turning-back portion B is located at a position, in the second tank 40, corresponding to the partition plate 31 of the first tank 30, that is, a position corresponding to the double chain line E in FIGS. 14 and 15.

The channel forming portion 41 of the present embodiment is arranged downstream of the turning-back portion B in the flow direction of the refrigerant in the second tank 40. Therefore, the first internal passage S21 located upstream of the channel forming portion 41 in the flow direction of the refrigerant is connected with the first tube 21*a* and one or plural second tubes 21*b* in the vicinity of the first tube 21*a*. The remaining second tubes 21*b* are connected to the second internal passage S22 located downstream of the channel forming portion 41 in the flow direction of the refrigerant.

According to the heat exchanger 10 of the present embodiment, the following effects (8) can be further obtained.

(8) When the liquid-phase refrigerant and the oil in the second tank 40 collide with the bottom surface 411 of the channel forming portion 41, the flow of the liquid-phase refrigerant and the oil is disturbed. Therefore, as shown by the arrow direction F1 in FIG. 15, a part of the liquid-phase refrigerant and the oil flows into the second internal passage S22 through the refrigerant channel 410. Further, as shown by the arrow direction F2 in FIG. 15, the other liquid-phase refrigerant and oil are blocked by the channel forming portion 41 and return from the channel forming portion 41 to the first internal passage S21. As shown in FIG. 15, when the channel forming portion 41 is arranged downstream of the turning-back portion B in the refrigerant flow direction in the second tank 40, a part of the second tube 21*b* is located on the upstream of the channel forming portion 41 in the refrigerant flow direction. Therefore, as shown by the arrow direction F2, a part of the liquid-phase refrigerant and the oil flows into the second tube 21*b*. As a result, the refrigerant containing the oil can easily flow into the second tube 21*b*, so that the oil return property can be improved.

Other Embodiments

The embodiments can be also implemented in the following forms.

The refrigerant channel 410 formed in the channel forming portion 41 of the first embodiment may have a polygonal shape other that the square shape in the cross-section orthogonal to the longitudinal direction A of the second tank 40.

The heat exchanger 10, in each of the embodiments, may include another tube other than the first tube 21*a* and the second tube 21*b*, for further supercooling the refrigerant cooled by the second tube 21*b*.

The present disclosure is not limited to the specific examples described above. The specific examples described above which have been appropriately modified in design by those skilled in the art are also encompassed in the scope of the present disclosure so far as the modified specific examples have the features of the present disclosure. Each element included in each of the specific examples described above, and the placement, condition, shape, and the like of the element are not limited to those illustrated, and can be modified as appropriate. The combinations of the elements in each of the specific examples described above can be changed as appropriate, as long as it is not technically contradictory.

What is claimed is:

1. A heat exchanger configured to be used as a condenser and an evaporator, through which a refrigerant containing oil for lubricating a compressor flows, the heat exchanger comprising:

a plurality of tubes in which the refrigerant flows to exchange heat with air flowing outside;

a first tank arranged to extend in a vertical direction and connected to one end of the plurality of tubes; and a second tank arranged to extend in the vertical direction and connected to the other end of the plurality of tubes, wherein the first tank has a first internal passage and a second internal passage arranged above the first internal passage in the vertical direction, the plurality of tubes includes a first tube communicated with the first internal passage of the first tank, and a second tube communicated with the second internal passage of the first tank, the refrigerant flows in order of the first internal passage of the first tank, the first tube, the second tank, the second tube, and the second internal passage of the first tank, a channel forming portion is provided inside the second tank to form a refrigerant channel having a cross-sectional area smaller than that of an internal passage of the second tank in a cross-section orthogonal to a longitudinal direction of the second tank, the refrigerant channel is arranged so that a projection area of the refrigerant channel overlaps the tube when viewed in the longitudinal direction of the second tank, an inner wall surface of the second tank has
a first portion into which the tube is inserted, and
a second portion located on an opposite side of the first portion with respect to a central axis of the second tank, and
the refrigerant channel is arranged so that a length of a wall surface of the channel forming portion from the second portion to the refrigerant channel is longer than a length of a wall surface of the channel forming portion from the first portion to the refrigerant channel, on an axis that passes through the central axis of the second tank and is parallel to a longitudinal direction of the tube.

2. The heat exchanger according to claim 1, wherein
the channel forming portion has a convex portion adjacent to an open end portion of the refrigerant channel.

3. The heat exchanger according to claim 2, wherein
the convex portion is formed around an opening end of the channel forming portion on an inflow side of the refrigerant channel.

4. The heat exchanger according to claim 1, wherein
an inner wall surface of the refrigerant channel is formed in a tapered shape.

5. The heat exchanger according to claim 1, wherein
an inner wall surface of the refrigerant channel is formed in a tapered shape so that the cross-sectional area of the refrigerant channel increases from an inlet-side opening end to an outlet-side opening end.

6. The heat exchanger according to claim 1, wherein
the channel forming portion has a plate shape.

7. The heat exchanger according to claim 1, wherein
the second tank has a turning-back portion corresponding to a boundary between the first internal passage and the second internal passage of the first tank, and
the channel forming portion is arranged downstream of the turning-back portion in a flow direction of the refrigerant inside the second tank.

8. The heat exchanger according to claim 1, wherein
the refrigerant channel has a polygonal shape in the cross-section orthogonal to the longitudinal direction of the second tank.

9. The heat exchanger according to claim 1, wherein
the tube is formed in a flat shape, and
the refrigerant channel has a shape elongated in a flat direction of the tube in a cross-section orthogonal to a central axis of the second tank.

10. The heat exchanger according to claim 1, wherein
an axis of the refrigerant channel is deviated from an axis of the second tank toward the tube.

11. The heat exchanger according to claim 10, wherein
ends of the tubes are located more adjacent to the axis of the refrigerant channel than to the axis of the second tank in the longitudinal direction of the tube.

12. The heat exchanger according to claim 1, wherein
the refrigerant channel is located between the tubes in the vertical direction, and overlaps with ends of the tubes in the longitudinal direction of the tube.

13. A heat exchanger configured to be used as a condenser and an evaporator, through which a refrigerant containing oil for lubricating a compressor flows, the heat exchanger comprising:
a plurality of tubes in which the refrigerant flows to exchange heat with air flowing outside;
a first tank arranged to extend in a vertical direction and connected to one end of the plurality of tubes; and
a second tank arranged to extend in the vertical direction and connected to the other end of the plurality of tubes, wherein
the first tank has a first internal passage and a second internal passage arranged above the first internal passage in the vertical direction,
the plurality of tubes includes a first tube communicated with the first internal passage of the first tank, and a second tube communicated with the second internal passage of the first tank,
the refrigerant flows in order of the first internal passage of the first tank, the first tube, the second tank, the second tube, and the second internal passage of the first tank,
a channel forming portion is provided inside the second tank to form a refrigerant channel having a cross-sectional area smaller than that of an internal passage of the second tank in a cross-section orthogonal to a longitudinal direction of the second tank,
the refrigerant channel is arranged so that a projection area of the refrigerant channel overlaps the tube when viewed in the longitudinal direction of the second tank,
an inner wall surface of the second tank has
a first portion into which the tube is inserted, and
a second portion located on an opposite side of the first portion with respect to a central axis of the second tank,
the refrigerant channel is arranged so that a length of a wall surface of the channel forming portion from the second portion to the refrigerant channel is longer than a length of a wall surface of the channel forming portion from the first portion to the refrigerant channel, on an axis that passes through the central axis of the second tank and is parallel to a longitudinal direction of the tube, and
the refrigerant channel overlaps with ends of the tubes in the longitudinal direction of the tube.

14. The heat exchanger according to claim 13, wherein
an axis of the refrigerant channel is deviated from an axis of the second tank toward the tube.

15. The heat exchanger according to claim 14, wherein
ends of the tubes are located more adjacent to the axis of the refrigerant channel than to the axis of the second tank in the longitudinal direction of the tube.

* * * * *